US006250938B1

(12) United States Patent
Tung

(10) Patent No.: US 6,250,938 B1
(45) Date of Patent: Jun. 26, 2001

(54) ELECTRICAL CONNECTOR WITH CIRCUIT BOARD EJECTOR

(75) Inventor: Shyh-Lin Tung, Taiping (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/389,444

(22) Filed: Sep. 2, 1999

(30) Foreign Application Priority Data

Sep. 4, 1998 (TW) ..... 87214577

(51) Int. Cl.[7] ..... H01R 13/62

(52) U.S. Cl. ..... 439/160; 439/152; 439/153; 439/346

(58) Field of Search ..... 439/160, 159, 439/158, 157, 156, 155, 154, 153, 152, 346, 567, 571

(56) References Cited

U.S. PATENT DOCUMENTS

| | | | | |
|---|---|---|---|---|
| Re. 35,735 | | 2/1998 | Douty et al. | 439/571 |
| 4,129,351 | | 12/1978 | Sugimoto et al. | 339/176 |
| 4,761,141 | * | 8/1988 | Hawk et al. | 439/153 |
| 5,154,634 | | 10/1992 | Brown et al. | 439/553 |
| 5,387,115 | | 2/1995 | Kozel et al. | 439/157 |
| 5,393,247 | | 2/1995 | DiOrazio et al. | 439/567 |
| 5,407,365 | | 4/1995 | Lin | 439/636 |
| 5,520,545 | | 5/1996 | Sipe | 439/65 |
| 5,540,598 | | 7/1996 | Davis | 439/79 |

FOREIGN PATENT DOCUMENTS

| | | | |
|---|---|---|---|
| 0 281 296 | 9/1988 | (EP) | H01R/13/633 |
| 0 469 324 A2 | 2/1992 | (EP) | H01R/23/68 |
| WO 98/53654 | 5/1998 | (WO) | H01R/7/14 |

* cited by examiner

*Primary Examiner*—Gary F. Paumen
*Assistant Examiner*—Alexander Gilman
(74) *Attorney, Agent, or Firm*—Robert A. Yesukevich

(57) ABSTRACT

An electrical connector includes insulative housing with a slot for receiving an auxiliary circuit card, a pair of pivotable ejectors for ejecting the circuit card, and pair of fasteners for mounting the connector to a primary circuit board. Each of the fasteners is anchored within the housing and includes a projecting mounting portion that is insertably mountable in a mounting aperture in the primary circuit board. Each of the ejectors is pivotably mounted on an ejector retaining portion of the fastener. In an embodiment, the ejector retaining portion of the fastener is formed by two resilient beams arranged parallel to each other. The ejector fits between the beams. At a free end of each beam, a protrusion is formed which is held in a biased manner inwardly against a cooperative detent in a side of the ejector. The ejector is held pivotably by the opposed protrusions riding within the detents. The arrangement facilitates a slim design of the connector, occupying less space. Furthermore, the design avoids a need to form ejector mounting holes in sides of the housing wall, which undesirably weakens the housing.

12 Claims, 5 Drawing Sheets

ELECTRICAL CONNECTOR WITH CIRCUIT BOARD EJECTOR

BACKGROUND OF THE INVENTION

The present invention generally relates to the art of electrical connectors and, more particularly, to a circuit board connector having an ejector.

Circuit board connectors are widely used in electronic devices utilizing circuit boards. Typically, such a connector is used for mounting a daughter circuit board to a primary circuit board. The connector includes an elongated insulative housing which forms a slot dimensioned to receive an edge of the daughter circuit board. The daughter circuit board may be, for example, a memory module, interface card, or some other auxiliary circuit card.

The housing includes a plurality of conductive terminals with contact portions located in the slot for contacting correspondingly located contacts on the daughter circuit board. The housing is mounted to the primary circuit board so that tail ends of the conductive terminals, which extend from a bottom of the housing, are held in electrical contact with respective electrical contacts on the primary circuit board.

Known connectors further include a pair of ejectors for manually ejecting the daughter board from the slot in the connector housing. Each ejector has a handle portion and an engaging portion. The ejector is pivotally mounted to the housing within a slot therein, such that when the ejector handle is moved, the ejector pivots to move the engaging portion of the ejector. The engaging portion thereby pushes an inserted daughter circuit board from the slot in the connector housing. By pivoting both of the end-mounted ejectors, the daughter circuit board is ejected from the slot.

To mount the connector to the primary circuit board, the connector typically includes a pair of fasteners mounted to the respective ends the housing, in the same vicinity of the housing as the ejectors at the end of the slot. Each of the fasteners has a U-shaped anchoring portion having two upwardly-extending barbed beams for affixing the fastener to the housing, and a mounting portion that projects downwardly from the housing for insertion through a respective mounting hole in the circuit board.

To prevent the fastener from obstructing or impeding the pivotal movement of the ejector, the fastener is configured to not touch the ejector. In particular, the conventional connector is configured so that a gap or clearance exists between the ejector and the upwardly extending beams of the U-shaped anchoring portion of the fastener. Also, in a conventional connector, the fastener is not aligned with the ejector. These features require the housing to have a substantial width, occupying substantial space. A connector design is desirable which is more compact.

Moreover, the pivot holes formed in the walls of the housing typically extend completely through the housing. This undesirably sacrifices the structural strength of the housing. Additionally, such pivot holes must be formed during manufacturing, thereby increasing costs.

SUMMARY OF THE INVENTION

According to the invention, an electrical connector is provided having an improved structure for pivotally mounting the ejector within the housing. For example, in an embodiment of the invention, an electrical connector is provided to connect conductive pads on a daughter circuit board to conductors on a mother circuit board. The connector includes an insulative housing having side walls defining an elongated slot for receiving the daughter circuit board therein. The housing includes an ejector recess at one end of the elongated slot, and a fastener-receiving opening in communication with said recess. The housing holds a plurality of conductive terminals, each having a contact portion extending into the elongated slot for engaging a respective conductive pad on the daughter circuit board and a tail portion extending out of the housing for engaging a respective conductor on the mother circuit board. A fastener having an anchoring section for anchoring the fastener in the housing is mounted in the fastener-receiving opening of the housing. The fastener also has an engaging section for engaging the mother circuit board to fasten the connector to the mother circuit board. Furthermore, the connector includes an ejector mounted in the ejector recess. The ejector has a body section pivotally retained on the ejector-retaining section of the fastener and an ejection surface for engaging the daughter circuit board when the ejector is moved to urge the daughter circuit board in a direction away from the elongated slot.

An advantage of the present invention is to provide a connector which occupies a minimal amount of space.

A further advantage of the present invention is to provide a connector wherein the ejector and the fastener are linearly aligned.

Another advantage of the present invention is to provide a connector wherein the fastener is fashioned to pivotally hold the ejector.

A still further advantage of the present invention is to provide a connector which eliminates a need for a pivot hole in the connector housing for the ejector, thereby enhancing strength of the housing connector.

Additional features and advantages of the present invention are described in, and will be apparent from, the following detailed description, the claims and the Figures.

DETAILED DESCRIPTION OF PREFERRED EMBODIMENT

Figure 1:
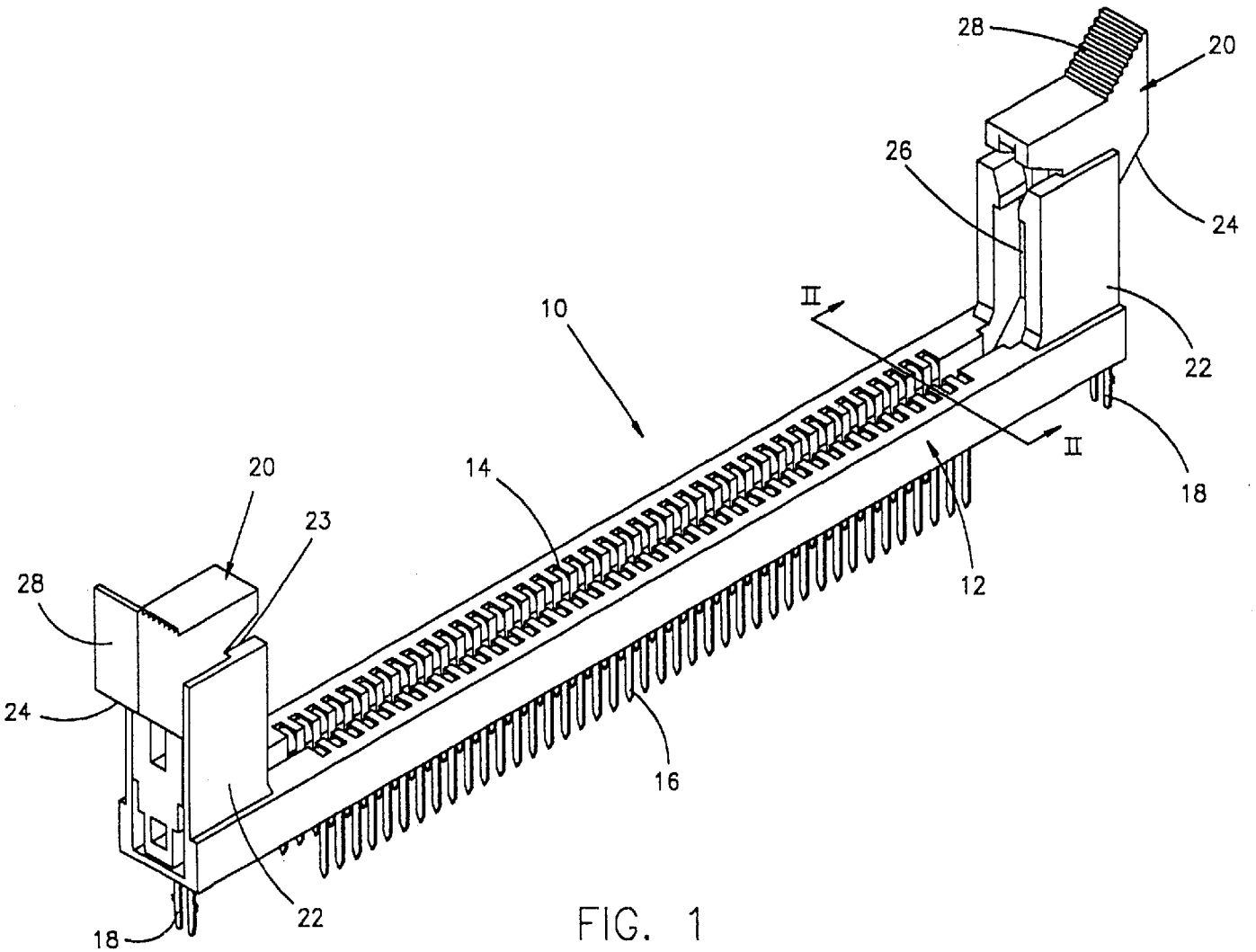
FIG. 1 is a perspective view of a connector constructed in accordance with teachings of the present invention.

Now referring to the drawings, wherein like numerals designate like components, FIG. 1 illustrates a circuit board connector 10 for connecting, for example, a memory module, interface card, or some other type of auxiliary card or daughter circuit card (not shown) to a primary circuit board (not shown). The connector 10 of FIG. 1 includes an, insulative housing 12 which forms an elongated slot 14 to receive an edge the daughter circuit board. A plurality of conductive terminals 16 are mounted within the housing12, and a portion of each terminal 16 is located in the slot 14 for contacting the edge of an inserted daughter circuit board. The terminals 16 also have tail ends which project downwardly from the housing 12 for insertion through conductive terminal apertures in the primary circuit board. At each end of the housing 12, the connector 10 includes a boardlock fastener 18 for mounting the connector 10 to the mother circuit board, as described below in greater detail.

Figure 2:
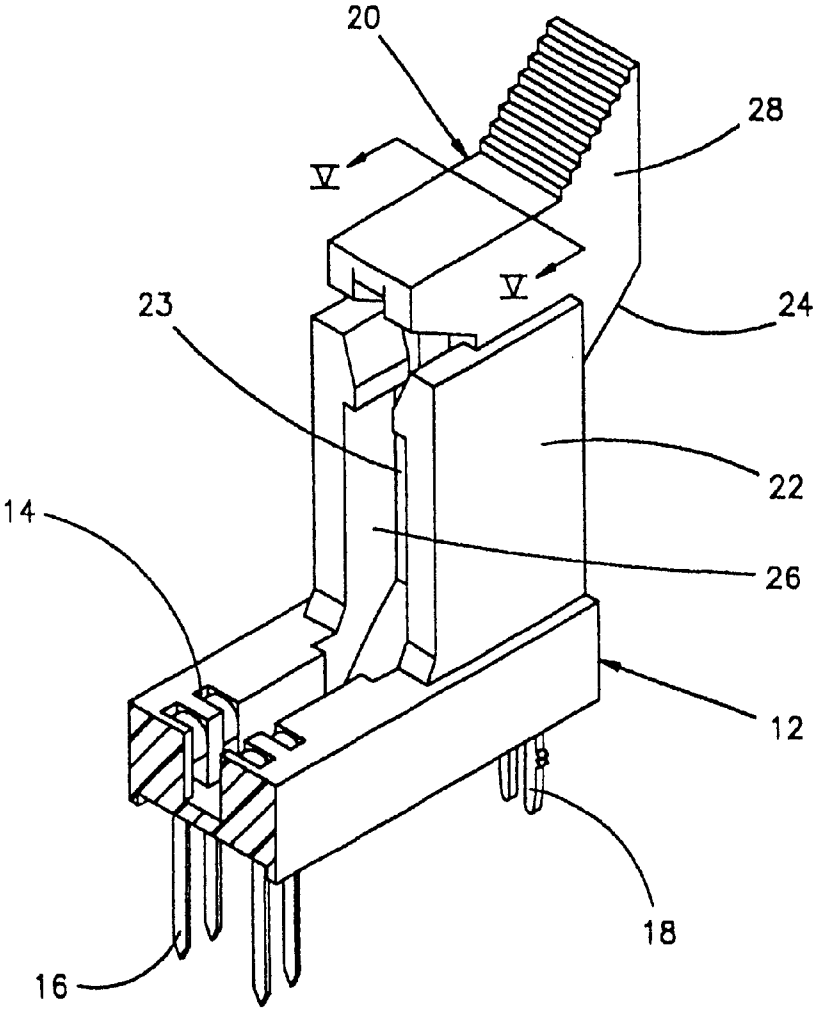
FIG. 2 is a fragmentary perspective view as taken generally along line II—II of FIG. 1.

For easy removal of a daughter circuit board from the slot 14, the connector 10 is equipped with a pair of retention devices or ejectors 20, as illustrated in FIGS. 1, 2. Each end of the housing 12 includes a pair of generally parallel wall segments 22 which define a ejector recess 23 therebetween. A portion of the ejector 20 resides within the ejector recess 23, supported by the wall segments 22. Each of the ejectors 20 has a body 24 which is pivotally mounted relative to the housing 20, as described in greater detail below. Generally, the ejector 20 is pivotable between a first position in which the daughter circuit board is installed in the slot 14, as illustrated, and a second position for ejecting the daughter circuit board from the slot 14. A cavity 26 is formed in the body 24 for receiving a lateral side of the daughter circuit board when the daughter circuit board is installed in the slot 14. The body 24 extends upwardly from the housing, forming a handle 28 which is accessible for manual gripping.

Figure 3:
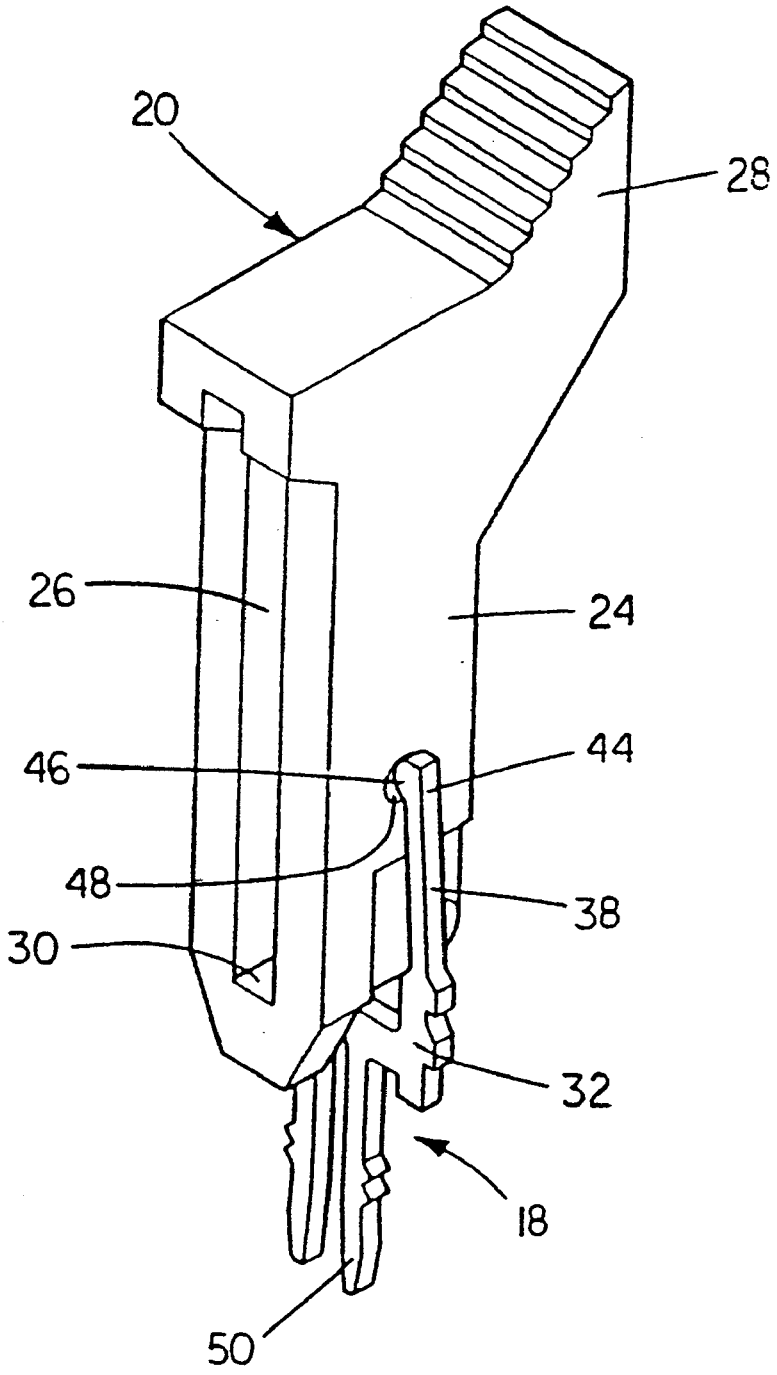
FIG. 3 is a perspective view of the fastener and ejector as assembled in the connector of FIG. 1.

Referring to FIG. 3, each of the ejectors 20 has a lower ejection portion 30 that contacts against a bottom edge of an installed daughter circuit board. For ejecting the daughter board from the connector 10, a user pushes upon the handle 28 in a laterally outward direction, pivoting the ejector 20. This causes the lower ejection portion 30 of the ejector 20 to engage and push against the inserted edge of the daughter board, urging the daughter board out and away from the slot 14. FIG. 3 also illustrates the fit relationship of the ejector 20 relative to the fastener 18, by which the fastener 18 securely holds the ejector 20 in a pivotal manner.

Figure 4:
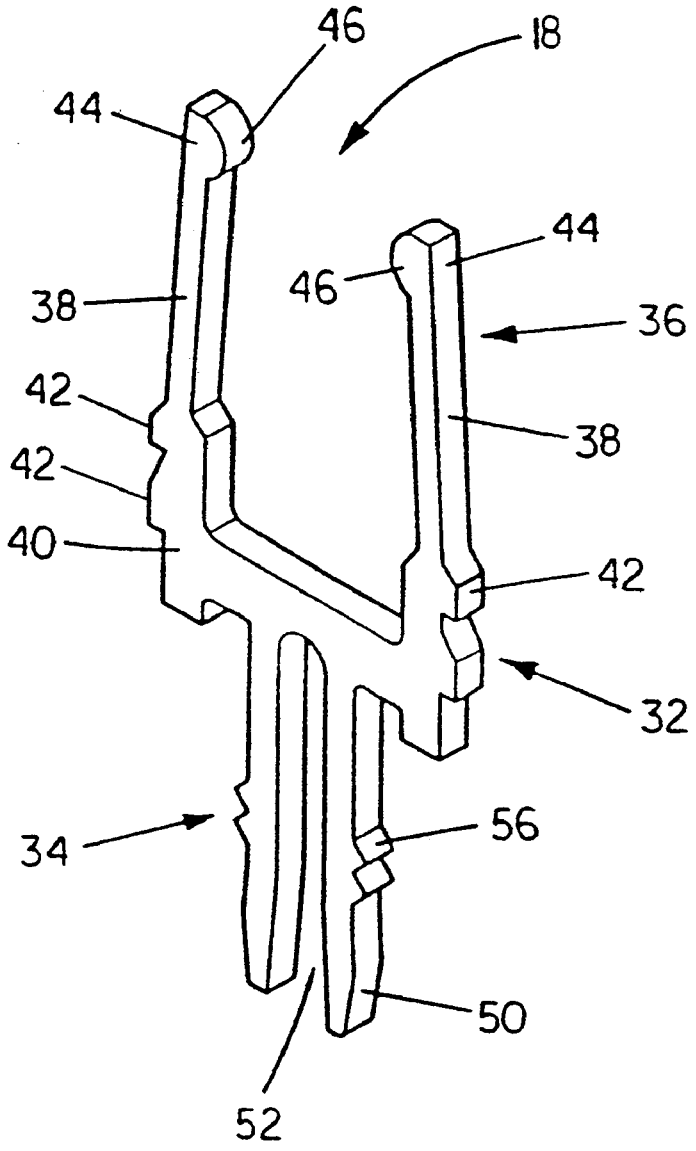
FIG. 4 is a perspective view of the fastener of the connector of FIG. 1.
Figure 5:
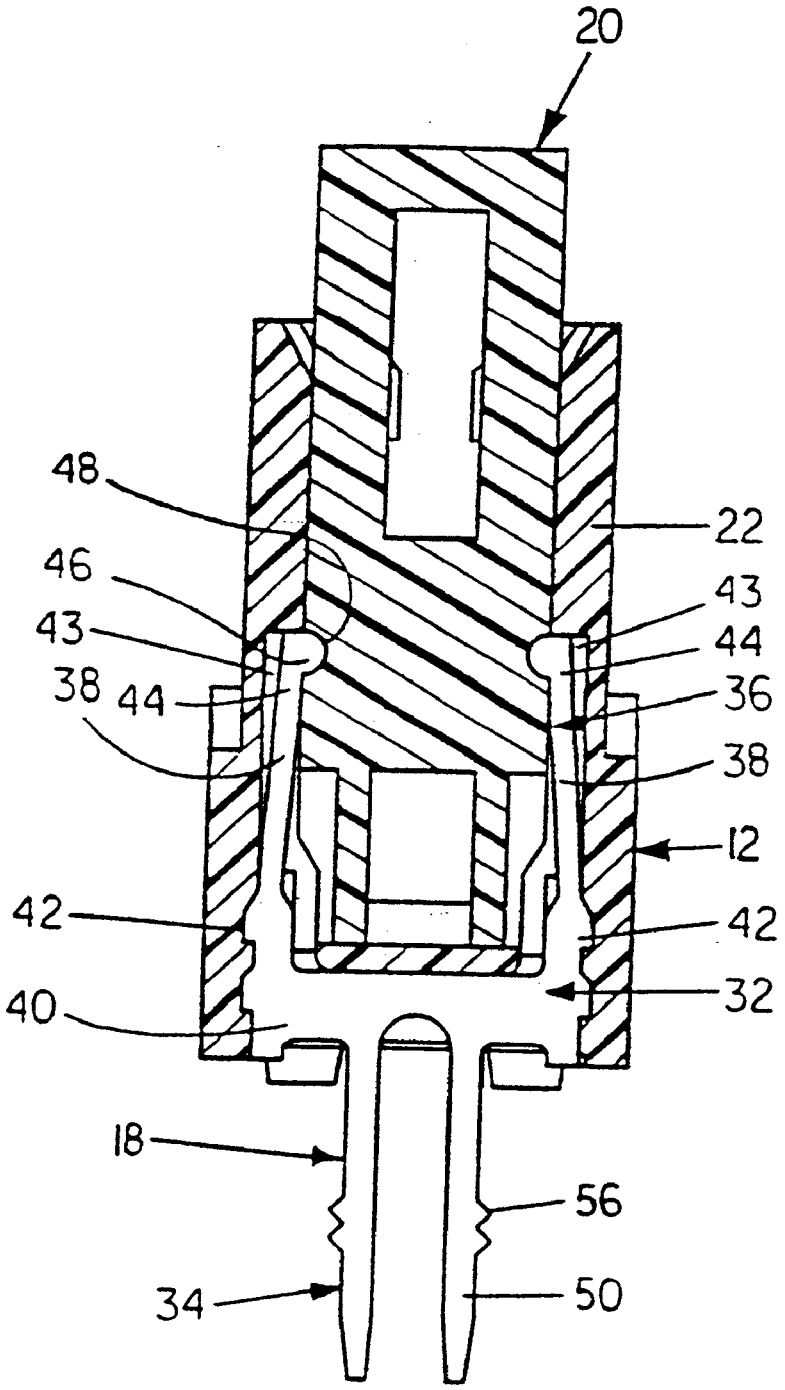
FIG. 5 is a cross-sectional side view as taken generally along line V—V of FIG. 2.

FIGS. 4 and 5 illustrate the fastener 18 in greater detail. The fastener 18 includes a U-shaped anchoring section 32, a board engaging section 34 and an ejector retaining portion 36. The U-shaped anchoring section 32 has two generally parallel beams 38 which extend generally perpendicularly from a bar-shaped base 40. Each of the beams 38 has one or more barbs 42 located at an outer edge thereof for gripping a wall of the housing 12. More specifically, referring to FIG. 5, the anchoring section 32 is inserted into a fastener-receiving opening in the bottom of the housing, the opening being a slot defined by a pair of grooves 43 formed within opposed walls of the housing 12. Each of the grooves 43 receives a respective one of the beams 38, and the barbs 42 of the anchoring section 32 skive into the housing 12 at the groove, holding the fastener 18 fixed therein.

In accordance with the invention, the fastener 18 is configured to pivotably retain the ejector. As illustrated in FIGS. 4 and 5, the ejector-retaining portion 36 is formed by upper free ends 44 of the beams 38 which extend away from the base 40. In an embodiment, the beams 38 are curved or bent inwardly, as illustrated, so that the free ends 44 converge inwardly toward each other. Each end 44 is shaped to have an inwardly directed protrusion 46 for cooperatively engaging a respective detent 48 in a side of the ejector 20, as shown in FIGS. 3 and 5. The fastener 18 thereby holds the ejector 20 for pivotal movement in the housing 12 of the connector 10. As illustrated in FIG. 5, the fastener 18 contacts the ejector 20 in the vicinity of the detent 48, but not significantly otherwise.

During assembly of the connector 10, the ejector 20 is inserted into the ejector recess 24. The ejector 20 may have lower sides that are recessed inwardly, so that the ejector 20 can be inserted downwardly into the space between the beams 38 of the fastener 18. The side surfaces of the ejector 20 urge the respective protrusions outwardly as the ejector is inserted into the housing 12. At a point when the ejector 20 is fully inserted the point the protrusions 46 nest in the detents 48 with a snap-fit.

By pivotally mounting the ejector 20 on the fastener 18, the housing 12 can be made with a compact, slim design. Additionally, the design aligns the fastener 18 with the ejector 18, further allowing reduced size of the connector 10. Advantageously, the housing 12 needs no holes for hinging the ejector 20, as was a feature of conventional connectors, thereby providing simplified molding of the housing 12 as compared to previous designs. Depending on the load to which the ejector 20 will be subjected when ejecting a daughter circuit board from the connector 10, the floor of the ejector recess 23 may be constructed with a support structure to assist the protrusions 46 in bearing the load.

In order to secure the connector 10 to the primary circuit board, the board engaging section 34 of the fastener 18, in the exemplary embodiment illustrated in FIGS. 4 and 5, includes a pair of generally horizontal legs 50 which extend from the base 40 in a direction away from the beams 38. As illustrated in FIG. 5, the legs 50 project from the housing 12. The legs 50 are resilient, and a gap 52 is formed between the legs 50 to facilitate resilient inward movement. The engaging section 34 is inserted into a corresponding mounting aperture in the mother circuit board whereby the connector 10 is fixed relative thereto. Specifically, the legs 50 flex inwardly toward each other as the engaging section 34 is inserted into the mounting hole, and the legs 50 thus bias outwardly against the surface of the mounting aperture. Additionally, each of the legs 50 has a plurality of outwardly-directed barbs 56 to securely grip the circuit board, retaining the fastener 18 in the aperture.

It is noted that the engaging section 34 of the fastener 18 may be provided with a differently shaped structure, instead of the parallel legs 50 illustrated. For example, the engaging section 34 may be an arrowhead-shaped structure, or some other type of mounting element.

Although the present invention has been described with reference to an embodiment which is presently preferred, it will be understood that the invention is not limited to the specific features of the described embodiment. Various substitutions and modifications to the present invention will be apparent to those skilled in the art. Such substitutions and modifications may be made without departing from the spirit and scope of the invention. Accordingly, the appended claims are intended to encompass such substitutions and modifications.

What is claimed is:

1. An electrical connector for connecting conductive pads on a daughter circuit board to conductors on mother circuit board comprising:

an insulative housing having side walls defining an elongated groove for receiving the daughter circuit board therein, said housing defining terminal cavities along the elongated groove, an ejector recess at one end of the elongated groove, and a fastener-receiving opening in communication with said recess;

terminals mounted in said terminal cavities having a contact portion extending into the elongated groove for engaging a respective conductive pad on the daughter circuit board and a tail portion extending out of the housing for engaging a respective conductor on the mother circuit board;

a fastener having an anchoring section for anchoring the fastener in said fastener-receiving opening of the housing, an engaging section for engaging the mother circuit board to fasten the connector to the mother circuit board and an ejector-retaining section which comprises opposed beams extending upwardly from said anchoring section of said fastener, each opposed beam of the ejector-retaining section including a free end which forms a protrusion; and an ejector having a body forming an ejection surface and detents, each detent engaging one of the protrusions to pivotally retain said ejector in said ejector recess, the ejector being pivotally mounted on the ejector-retaining section of the fastener within the ejector recess of the housing such that when the ejector is pivoted, the ejection surface pushes the daughter circuit board in a direction away from the elongated groove.

2. The electrical connector of claim 1, wherein the fastener-receiving opening comprises a slot in the bottom surface of housing that communicates with the recess.

3. The electrical connector of claim 2 wherein opposed grooves in side walls of said ejector recess register with ends of said slot in said bottom surface of said housing.

4. The electrical connector of claim 1 wherein said free ends of said opposed beams on said ejector-retaining section of said fastener converge toward each other away from an inner wall of said respective groove to allow flexure of said beam when the ejector is loaded into said ejector recess.

5. An electrical connector for connecting conductors on a first component to conductors on a second component, said connector comprising:

a housing having side walls defining a receptacle for receiving the first component therein, said housing defining terminal cavities along the receptacle, and a recess proximate the receptacle for containing a retention device;

terminals mounted in said terminal cavities having a contact portion extending into the receptacle for engaging a respective conductor on the first component and a tail portion extending out of the housing for engaging a respective conductor on the second component;

a fastener having an anchoring section for anchoring the fastener in said housing, a retention-holding section for pivotally holding said retention device in said recess and an engaging section for engaging the second component to fasten the connector to the second component, the retention-holding section comprising opposed beams extending upwardly from said anchoring section, and each opposed beam including a free end which forms a protrusion; and a retention device which is mounted in the recess and defines detents and an engaging surface, each of detents engaging one of the protrusions to pivotally retain said retention device in said recess, and the engaging surface engaging the first component when the retention device is moved.

6. The electrical connector of claim 1 including a fastener-receiving slot in a bottom surface of said housing, said slot in communication with said recess.

7. The electrical connector of claim 6, wherein opposed grooves in side walls of said recess register with ends of said slot in said bottom surface of said housing.

8. The electrical connector of claim 5, wherein said free ends of said opposed beams on said retention-keeping section of said fastener converge toward each other away from an inner wall of said respective groove to allow flexure of said beam when the retention device is loaded into said recess.

9. An electrical connector for connecting conductive pads on a daughter circuit board to conductors on mother circuit board comprising:

an insulative housing having side walls defining an elongated groove for receiving the daughter circuit board therein, said housing defining terminal cavities along the elongated groove, a recess at one end of the elongated groove, and a slot in a bottom surface of said housing in communication with said recess for receiving a fastener;

terminals mounted in said terminal cavities having a contact portion extending into the elongated groove for engaging a respective conductive pad on the daughter circuit board and a tail portion extending out of the housing for engaging a respective conductor on the mother circuit board;

a fastener having an anchoring section for anchoring the fastener in said fastener-receiving opening of the housing, a pair of opposed beams extending upwardly from said anchoring section, free ends of said opposed beams including protrusions, and an engaging section for engaging the mother circuit board to fasten the connector to the mother circuit board; and a retention device mounted in the recess, said retention device including a body section having opposed surfaces each including detents for receiving protrusions of the opposed beams to pivotally retain the retention device in the recess, and an engagement surface for engaging the daughter circuit board when the ejector is pivoted.

10. The electrical connector of claim 9 wherein opposed notches in side walls of said recess register with ends of said slot in said bottom surface of said housing.

11. The electrical connector of claim 10 wherein said free ends of said opposed beams on said retention-keeping section of said fastener converge toward each other away from an inner wall of said respective notch to allow flexure of said beam when the retention device is loaded into said recess.

12. The electrical connector of claim 11 wherein said anchoring section of said retention device has barbs for skiving into end walls of said slot in said bottom surface of said housing.

* * * * *